US009341436B2

(12) United States Patent
Frankel

(10) Patent No.: US 9,341,436 B2
(45) Date of Patent: May 17, 2016

(54) GUN ASSEMBLY INCLUDING GUN ACTION MATED TO GUNSTOCK BY AT LEAST THREE ZONES OF INTENTIONAL INTERFERENCE FIT

(71) Applicant: Kenneth A Frankel, Kent, WA (US)

(72) Inventor: Kenneth A Frankel, Kent, WA (US)

( * ) Notice: Subject to any disclaimer, the term of this patent is extended or adjusted under 35 U.S.C. 154(b) by 6 days.

(21) Appl. No.: 14/459,207

(22) Filed: Aug. 13, 2014

(65) Prior Publication Data

US 2016/0047623 A1 Feb. 18, 2016

(51) Int. Cl.
*F41A 17/06* (2006.01)
*F41C 23/00* (2006.01)

(52) U.S. Cl.
CPC ..... *F41C 23/00* (2013.01)

(58) Field of Classification Search
CPC ..... F41C 23/16; F41C 23/12; F41C 23/18; F41C 33/007; F41C 7/02; F41C 23/20; F41C 23/00; F41A 21/484; F41A 21/487; F41A 11/02; F41A 21/06; F41A 3/12; F41A 23/02; F41A 3/84
USPC ..... 42/71.01
See application file for complete search history.

(56) References Cited

U.S. PATENT DOCUMENTS 2,479,594 A 7/1948 Yasho
2,749,594 A * 6/1956 Tanner ..... B65H 63/061 28/237
4,385,464 A * 5/1983 Casull ..... F41C 23/00 42/75.03
4,555,860 A 12/1985 Zedrosser
4,674,216 A * 6/1987 Ruger ..... F41C 23/18 42/71.01
5,068,991 A 12/1991 Reed
6,044,748 A 4/2000 Westrom
6,427,372 B1 * 8/2002 Howard ..... F41C 23/00 42/71.01
6,487,805 B1 * 12/2002 Reynolds ..... F41A 21/485 42/75.03
7,331,135 B2 2/2008 Shimi
7,638,084 B2 12/2009 Frankel
7,841,119 B1 11/2010 Boyd
7,926,217 B2 * 4/2011 McCann ..... A41C 23/16 42/75.02
8,015,740 B2 * 9/2011 Jamison ..... F41A 21/00 42/14
8,881,444 B2 * 11/2014 Warburton ..... F41A 11/00 42/74
2005/0217470 A1 10/2005 Bevacqua
2007/0074442 A1 4/2007 Richeson
2012/0204465 A1 * 8/2012 Hasler ..... F41A 3/64 42/75.03
2014/0190055 A1 7/2014 Warburton

* cited by examiner

*Primary Examiner* — Troy Chambers
*Assistant Examiner* — Bridget Cochran
(74) *Attorney, Agent, or Firm* — Thomas E. Loop

(57) ABSTRACT

A gun assembly comprising a cylindrical gun action mated within a generally semi-cylindrical cavity of a synthetic gunstock to thereby define a specialized interference fit between the gunstock and the gun action is disclosed herein. The innovative gun assembly comprises at least three zones of interference fit established by assembling together a synthetic gunstock that includes a specialized receiving cavity generally in the form of a semi-cylinder and defined by a first radius $R_1$ (correspond to zone surfaces) and a second radius $R_2$ (corresponds to relief surfaces); and a metallic gun action generally in the form of a cylinder defined by a third radius $R_3$. In order to achieve the specialized interference fit, the length of the third radius is selected to be slightly greater than the length of the first radius.

6 Claims, 3 Drawing Sheets

GUN ASSEMBLY INCLUDING GUN ACTION MATED TO GUNSTOCK BY AT LEAST THREE ZONES OF INTENTIONAL INTERFERENCE FIT

TECHNICAL FIELD

The present invention relates generally to firearms and guns, and more particularly, to a gun assembly that includes a gun action mated to a synthetic gunstock by at least three distinct zones of intentional interference fit, as well as to related kits and methods of making the same.

BACKGROUND OF THE INVENTION

A firearm (or gun) is a portable barreled weapon that uses explosive powder (gun powder) to propel a metal (usually lead) projectile (bullet) towards a target. Firearms include, for example pistols, shotguns, and rifles. The conventional practice for assembling a high-accuracy rifle is to employ the services of a gunsmith to create a "conformal fit" between the cylindrical outside surface of the body of the rifle action (the receiver) and the generally concave cavity of a corresponding rifle stock. The creation of a conformal fit between the rifle action and the rifle stock is a laborious process, which process is believed necessary in order to establish a near perfect match between the respective mating geometries. In other words, a uniform and near perfect match between the mating geometries of the cylindrical rifle action and the generally semi-cylindrical cavity of the rifle stock is believed to be advantageous.

In firearms terminology, an "action" (or receiver) is the physical mechanism (usually symmetrical) that manipulates cartridges and/or seals the breech. This term may also be used to describe the method by which cartridges are loaded, locked, and extracted from the mechanism. A "cartridge" is the cylindrical housing that holds the gun powder behind the bullet and, after loading, is positioned within the action. As is appreciated by those skilled in the art, gun actions are generally categorized by the type of mechanism used. Many modern mass produced firearms are breech-loading.

The gun barrel is a tube from which the bullet is projected. The gun barrel is generally integrally connected to the action along a central axis. After firing, the pressure of gases projecting a rifle bullet out of the barrel can reach about 50,000 pounds per square inch (3,333 bar) and temperatures of about 3,500 degrees Fahrenheit (2,200° C.). These high pressures and temperatures rise and fall during the few milliseconds (thousandths of seconds) it takes for the bullet to travel through the action and out of the barrel. In combination, these forces momentarily alter the geometries of the action and the barrel. Pistol and shotgun rounds generally operate at considerably lower pressures than rifle rounds (approximately one third). Regardless of the type of gun, the forces (horizontal and lateral) imparted to the gun barrel, gun action, and gunstock during a firing event are generally symmetrical about the central axis and its vertical plane (due, in part, to recoil forces in the vertical plane).

Although firearm technology and manufacturing processes have advanced over the years, there is still a need in the art for new and improved types of mass producible gun assemblies—gun assemblies that have improved reliability and accuracy, as well as to related methods and unassembled kits for making the same. The present invention fulfills these needs and provides for further related advantages.

SUMMARY OF THE INVENTION

In brief, the present invention in an embodiment is directed to a gun assembly comprising a cylindrical gun action mated within a generally semi-cylindrical cavity of a synthetic gunstock to thereby define a specialized interference fit between the gunstock and the gun action. In accordance with an aspect of the invention, the interference fit may be considered non-conformal and comprises at least three distinct zones of intentional deformation between the more readily deformable synthetic material (preferably a carbon fibre reinforced polymer) of the gunstock and the more resilient material (preferably metallic) of the gun action, wherein two of the at least three zones of intentional deformation are diametrically opposed (or nearly diametrically opposed) to each other along a horizontal plane that is coextensive with the central axis of the gun action (i.e., on the sides), and wherein a third zone of the at least three zones of intentional deformation is positioned equidistant between the two other zones of intentional deformation (i.e., on the bottom). In addition, the third zone of the at least three zones of intentional deformation is separated from the two other zones of intentional deformation by way of respective first and second reliefs positioned along the cavity wall surface of the gunstock on either side of the third zone. It is believed that this specialized configuration and geometry (associated with the inventive gun assembly) more appropriately distributes forces (lateral and/or vertical) between the gun action and gunstock during a firing event, and enables the cost-effective mass production of highly accurate and reliable composite guns.

In another aspect, the present invention is directed to a kit of unassembled gun components. The inventive kit includes at least a synthetic (carbon reinforced polymer) gunstock and a metallic gun action. The synthetic gunstock includes a specialized receiving cavity that is generally in the form of a semi-cylinder, wherein the walls of the receiving cavity are generally defined by a first radius $R_1$ (which corresponds to the top surfaces of the at least three zones of interference fit) and a second radius $R_2$ (which corresponds to the bottom surfaces of the first and second reliefs). In other words, the length of the first radius is less than the length of the second radius ($R_1<R_2$). The metallic gun action has a central portion that is generally in the form of a cylinder having an outer wall surface generally defined by a third radius $R_3$. In order to achieve an interference fit, the length of the third radius is selected to be slightly greater than the length of the first radius. In some embodiments, the geometry associated with the interferences zones is approximately one fifth of the radial interference (i.e, $0.2(R_3-R_2)$) which equates to a tolerance of ±0.001 inches.

In another embodiment, the present invention is directed to a method of making a gun assembly comprising at least the following steps: providing a gunstock made of a synthetic material, wherein the gunstock has a semi-cylindrical cavity for receiving a gun action, wherein the semi-cylindrical cavity has a cavity wall surface defined by first and second radii that extend from a central axis to the cavity wall surface, wherein the length of the first radius is less than the length of the second radius, and wherein the first radius defines a contact surface for each of the at least three zones and the second radius defines first and second reliefs, and wherein two of the three zones are diametrically opposed or are nearly diametrically opposed to each other along a horizontal plane that is coextensive with the central axis of the gun action, and wherein a third zone of the three zones is positioned equidistant between the two other zones, and wherein the respective first and second reliefs separate the third zone from the two other zones; providing a cylindrical gun action having a third radius, wherein the length of the third radius of the gun action is larger than the length of the second radius of the cavity of the gunstock; and mating the gun action into the cavity of the gunstock such that the gun action contacts the contact surface of the at least three zones to thereby yield the at least three zones of intentional interference fit.

These and other aspects of the present invention will become more evident upon reference to the following detailed description and attached drawings. It is to be understood, however, that various changes, alterations, and substitutions may be made to the specific embodiments disclosed herein without departing from their essential spirit and scope.

BRIEF DESCRIPTION OF THE DRAWINGS

The drawings are intended to be illustrative of certain preferred embodiments of the present invention. Like reference numerals have been used to designate like parts and features throughout the several views of the drawings.

DETAILED DESCRIPTION OF THE INVENTION

The present invention in an embodiment is directed to a gun assembly that includes a gun action mated to a synthetic gunstock by at least three distinct zones of intentional interference fit. In the several embodiments disclosed herein, the assemblies and methods are shown and described generally in the context of a high accuracy composite rifle. It is to be understood, however, that other types of guns and manufacturing processes are contemplated and within the scope of the present invention.

The inventive gun assembly includes a gun action mated to a gunstock establishing at least three distinct zones of contact therebetween. The contact between the gunstock and gun action results in elastic deformation of both of these parts, wherein the deformation of the gunstock is significantly greater than the deformation of the gun action (thus establishing an interference fit). As used herein, the term interference fit refers to the joining of parts whereby one or both of the parts undergo elastic deformation that results in a stable preloaded condition after assembly. This preloaded condition acts to inhibit motion between the parts and maintain contact between the faying surfaces even when small displacements occur, which, in turn, yields a gun assembly that has enhanced stability during the firing event.

Figure 1:
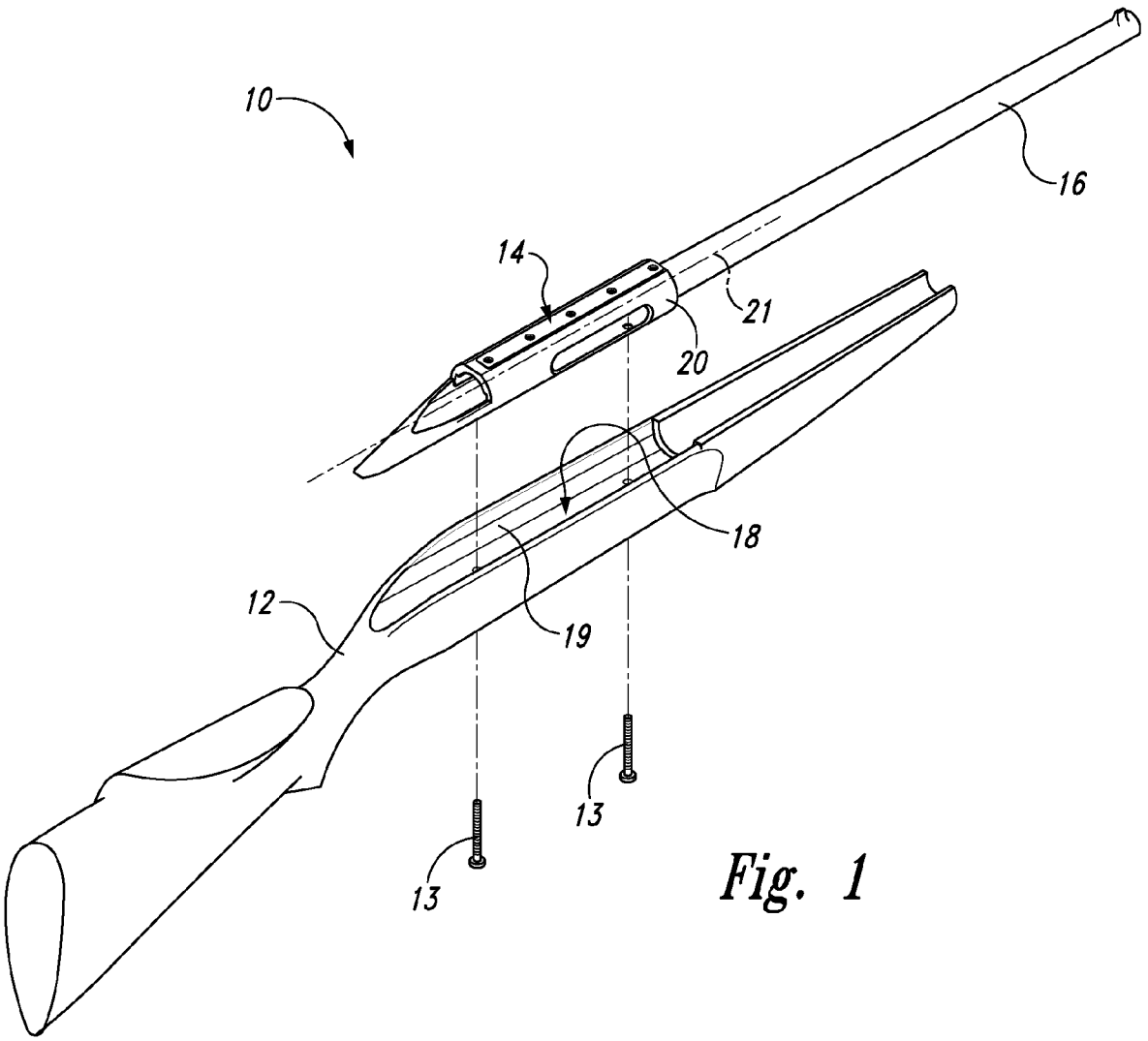
FIG. 1 is a partially exploded perspective view of a rifle assembly in accordance with an embodiment of the present invention.
Figure 2:
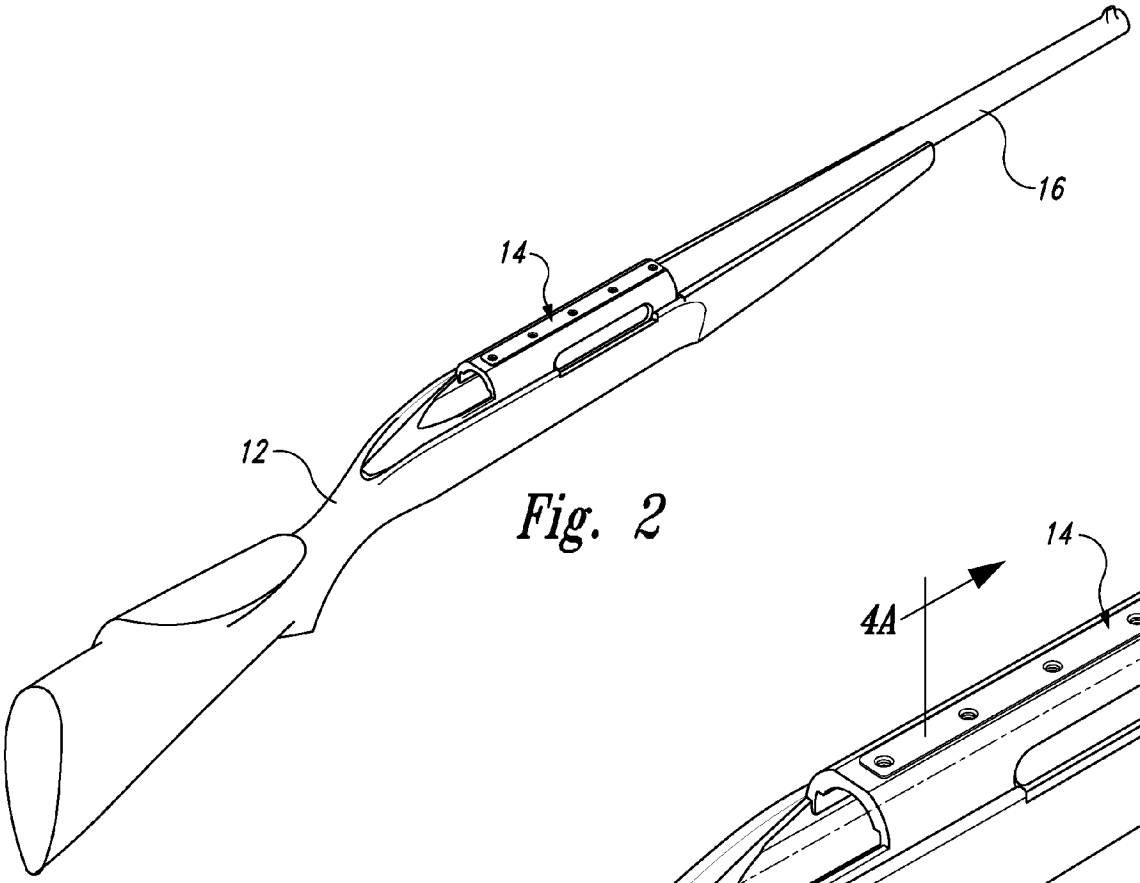
FIG. 2 is an assembled perspective view of the rifle assembly shown in FIG. 1.
Figure 3:
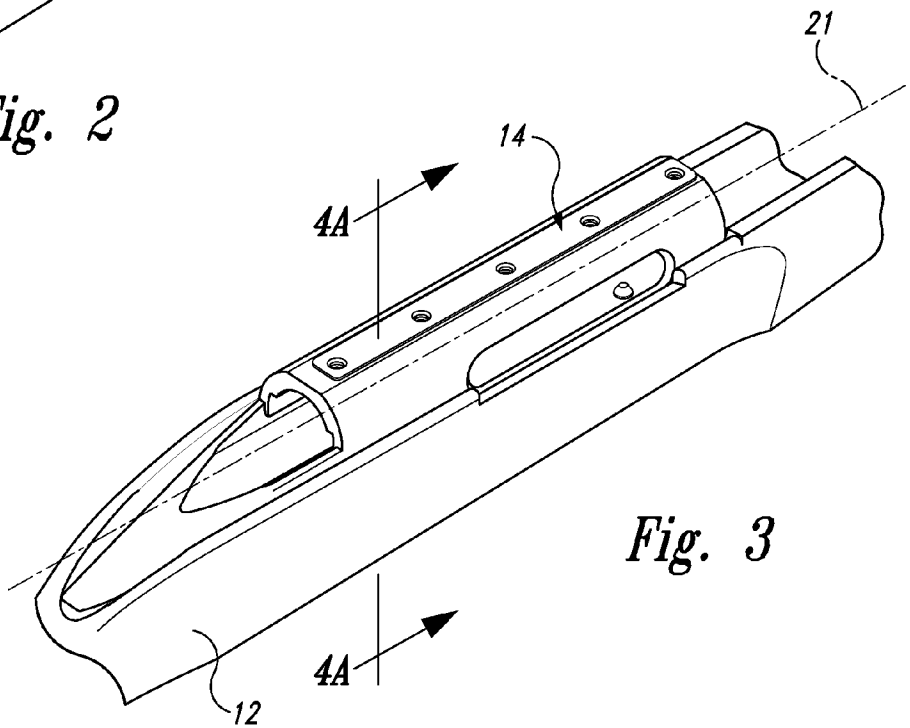
FIG. 3 is an enlarged partial view of the rifle action mated to the rifle stock shown in FIGS. 1 and 2.

Thus, and in view of the foregoing and with reference to FIGS. 1-4C, the present invention is directed to a rifle assembly 10 that includes: a rifle stock 12 made of a synthetic material (such as, for example, carbon reinforced polymer); a rifle action 14 made of a selected metal or metal alloy (such as, for example, AISA alloy steel); and a rifle barrel 16 integrally connected to the rifle action 14 along a central axis 21. As best shown in FIG. 1, the rifle stock 12 has a cavity 18 that defines a semi-cylindrical cavity wall surface 19, while the rifle action 14 has a corresponding cylindrically shaped outer wall surface 20. As best shown in FIGS. 1-3, the cylindrically shaped rifle action 14 may be securely fitted within the concave cavity 18 of the rifle stock 12, and held in place by means of longitudinally positioned first and second threaded screws 13*a*, 13*b*. As shown, the first and second threaded screws 13*a*, 13*b* are generally perpendicular to the central axis 21 and penetrate through the rife stock 12. The tightness or torque is selectively (and generally equally) applied to each of first and second threaded screws 13*a*, 13*b* to establish a secure interference fit.

Figure 4A:
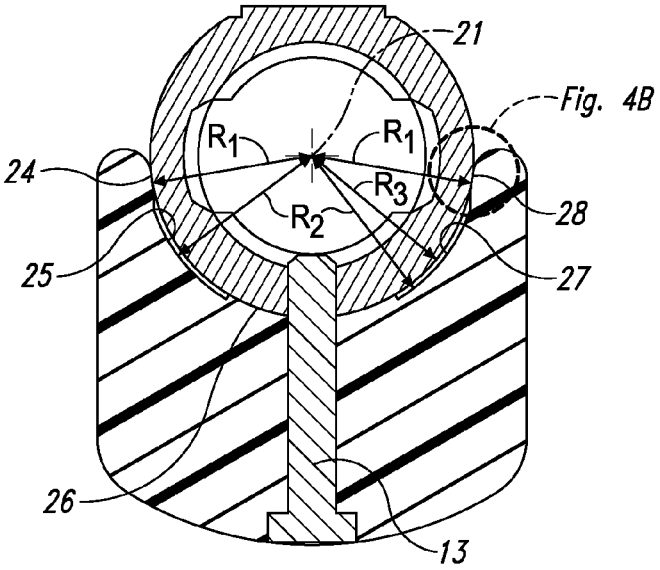
FIG. 4A is a cross-sectional view of the rifle action mated to the rifle stock taken along line 4A of FIG. 3.
Figure 4B:
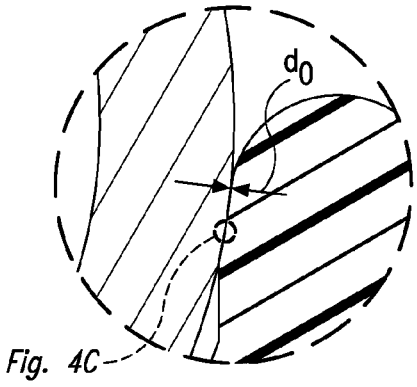
FIG. 4B is an enlarged view of a zone of intentional interference fit shown in FIG. 4A.
Figure 4C:
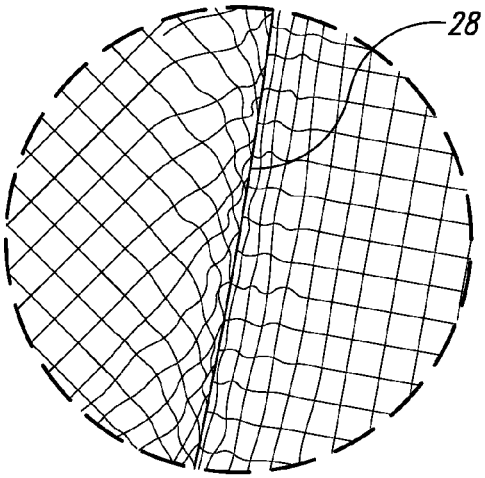
FIG. 4C is a further enlarged view of the zone of intentional interference fit shown in FIG. 4B and depicts localized elastic deformation associated with each of the rifle action and of the rifle stock in accordance with an embodiment of the present invention.

As best shown in FIG. 4A, the rifle action 14 may be mated within the cavity 18 of the rifle stock 12 to define a segmented interference fit interface between the rifle stock 12 and the rifle action 14. More specifically, the segmented interference fit comprises at least three zones of intentional interference fit 24, 26, 28, wherein the at least three zones of intentional interference fit 24, 26, 28 are generally symmetrically positioned about the central axis 21. As shown, two 24, 28 of the at least three zones of intentional interference fit 24, 26, 28 are nearly diametrically opposed to each other along a horizontal plane that is coextensive with the central axis 21 of the rifle action 14 (i.e., along the side walls at roughly the 3 and 6 o'clock position), and wherein a third zone 26 (of the at least three zones of intentional interference fit 24, 26, 28) is positioned equidistant between the two other (i.e., at roughly the 6 o'clock position). In addition, the third zone 26 of the at least three zones of intentional interference fit 24, 26, 28 is separated from the two other zones by way of respective first and second reliefs 25, 27. The first and second reliefs 25, 27 are positioned along the cavity wall surface 19 of the rifle stock 12 on either side of the third zone 26. Moreover, the first and second threaded screws 13*a*, 13*b* may be selectively and appropriately tightened to increase the force between the third zone 26 and the rifle action 14 (and, hence, the amount of deformation). It is believed that this configuration and geometry (associated with the inventive gun assembly) more appropriately distributes lateral and vertical forces between the rifle action 14 and rifle stock 12 during a firing event.

In the context of the present invention, the gunstock component of the present invention may be constructed of fiber reinforced polymer (FRP) (also sometimes referred to as fibre-reinforced polymer). The fibers are preferably carbon while the polymer is preferably an epoxy thermosetting plastic. The selected fibers and polymer are preferably combined together, with selected amounts of heat and pressure, within a mold (e.g., balding molding) to thereby yield the gunstock component of a desired geometry.

Stated somewhat differently, the synthetic gunstock 12 includes a specialized receiving cavity 18 that is generally in the form of a semi-cylinder, wherein the walls 19 of the receiving cavity 18 are generally defined by a first radius $R_1$ (which corresponds to the top surfaces of the at least three zones of interference fit 24, 26, 28) and a second radius $R_2$ (which corresponds to the bottom surfaces of the first and second reliefs 25, 27). In other words, the length of the first radius is less than the length of the second radius ($R_1<R_2$). The metallic gun action 14 has a central portion that is generally in the form of a cylinder having an outer wall surface 20 generally defined by a third radius $R_3$. In order to achieve an interference fit, the length of the third radius is selected to be slightly greater than the length of the first radius. In some embodiments, it is important to maintain $R_1$ to a manufacturing tolerance of approximately one fifth of the radial interference (i.e., $0.2(R_3-R_1)$) which equates to a tolerance of ±0.001 inches. In the embodiment of the invention illustrated in FIG. 1, the length of the first radius $R_1$ is about 0.673 inches, the length of the second radius $R_2$ is about 0.676 inches, and the length of the third radius $R_3$ is about 0.677 inches. Given that a typical third radius may be 0.676 inches, a first radius may then generally range from about 0.674 inches to about 0.662 inches, with the second radius being equal to the first radius plus about 0.0005 inches to about 0.050 inches, but preferably from about 0.002 inches to about 0.010 inches.

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing description, and all changes that come within the meaning and range of equivalency of the claims are to be embraced within their scope.

What is claimed is:

1. A gun assembly comprising:

a gunstock made of a synthetic material, the gunstock having a cavity that defines a cavity wall surface;

a gun action made of a selected metal or metal alloy, the gun action having a cylindrically shaped outer wall surface and a central axis; and a gun barrel connected to the gun action along the central axis;

characterized in that the gun action is mated within the cavity of the gunstock so as to define an interference fit between the gunstock and the gun action, wherein the interference fit comprises at least three distinct zones of intentional deformation between the synthetic material of the gunstock and the metal or metal alloy of the gun action, wherein two of the at least three zones of intentional deformation are diametrically opposed or are nearly diametrically opposed to each other along a horizontal plane that is coextensive with the central axis of the gun action, and wherein a third zone of the at least three zones of intentional deformation is positioned equidistant between the two other zones of intentional deformation, wherein the third zone of the at least three zones of intentional deformation is separated from the two other zones of intentional deformation by way of respective first and second reliefs positioned along the cavity wall surface of the gunstock on either side of the third zone.

2. The gun assembly of claim 1 wherein the at least three zones of intentional deformation between the synthetic material of the gunstock and the metal or metal alloy of the gun action are each elastic, and wherein the modulus of elasticity of the metal or metal alloy is greater than the modulus of elasticity of the synthetic material.

3. The gun assembly of claim 2 wherein the gun is a rifle and the gun action is a rifle action and the gunstock is a rifle stock.

4. The gun assembly of claim 2 wherein the synthetic gunstock is made from a composite material.

5. The gun assembly of claim 4 wherein the composite material comprises carbon fibers impregnated with a hardened epoxy resin.

6. A method of making a gun assembly comprising at least the following steps: providing a gunstock made of a synthetic material, wherein the gunstock has a semi-cylindrical cavity for receiving a gun action, wherein the semi-cylindrical cavity has a cavity wall surface defined by first and second radii that extend from a central axis to the cavity wall surface, wherein the length of the first radius is less than the length of the second radius, and wherein the first radius defines a contact surface for each of at least three zones and the second radius defines first and second reliefs, and wherein two of the three zones are diametrically opposed or are nearly diametrically opposed to each other along a horizontal plane that is coextensive with the central axis of the gun action, and wherein a third zone of the three zones is positioned equidistant between the two other zones, and wherein the respective first and second reliefs separate the third zone from the two other zones;

providing a cylindrical gun action having a third radius, wherein the length of the third radius of the gun action is larger than the length of the second radius of the cavity of the gunstock; and mating the gun action into the cavity of the gunstock such that the gun action contacts the contact surface of the at least three zones to thereby yield the at least three zones of intentional interference fit.

* * * * *